US010112158B2

(12) United States Patent
Schuhbeck et al.

(10) Patent No.: US 10,112,158 B2
(45) Date of Patent: Oct. 30, 2018

(54) DEVICE AND METHOD FOR FILLING CONTAINERS WITH A FILL PRODUCT

(71) Applicant: KRONES AG, Neutraubling (DE)

(72) Inventors: Thomas Schuhbeck, Hemau (DE); Manfred Faltermeier, Elsendorf (DE)

(73) Assignee: KRONES AG, Neutraubling (DE)

( * ) Notice: Subject to any disclaimer, the term of this patent is extended or adjusted under 35 U.S.C. 154(b) by 411 days.

(21) Appl. No.: 14/866,603

(22) Filed: Sep. 25, 2015

(65) Prior Publication Data

US 2016/0089643 A1 Mar. 31, 2016

(30) Foreign Application Priority Data

Sep. 26, 2014 (DE) ..... 10 2014 113 986

(51) Int. Cl.

| | |
|---|---|
| ***B67C 3/22*** | (2006.01) |
| ***B01F 7/16*** | (2006.01) |
| ***B01F 7/00*** | (2006.01) |
| ***B01F 15/06*** | (2006.01) |
| ***B01F 15/00*** | (2006.01) |
| ***B01F 15/02*** | (2006.01) |

(52) U.S. Cl.

CPC ..... *B01F 7/161* (2013.01); *B01F 7/0095* (2013.01); *B01F 7/00291* (2013.01); *B01F 15/00155* (2013.01); *B01F 15/00207* (2013.01); *B01F 15/0237* (2013.01); *B01F 15/06* (2013.01); *B01F 15/068* (2013.01); *B67C 3/22* (2013.01); *B01F 2215/0014* (2013.01); *B01F 2215/0022* (2013.01)

(58) Field of Classification Search

USPC ..... 366/146, 182.2, 286

See application file for complete search history.

(56) References Cited

U.S. PATENT DOCUMENTS

| | | | | |
|---|---|---|---|---|
| 2,691,282 | A * | 10/1954 | Snelson | F25D 31/003 141/199 |
| 2,703,966 | A * | 3/1955 | Snelson | A01J 9/04 165/104.31 |
| 4,008,048 | A * | 2/1977 | Hellemans | B01J 19/0013 422/134 |
| 4,593,612 | A | 6/1986 | Rieger | |
| 4,817,397 | A * | 4/1989 | Grischenko | A01N 1/02 62/46.1 |

(Continued)

FOREIGN PATENT DOCUMENTS

| | | |
|---|---|---|
| AU | 3974768 | 8/1968 |
| DE | 563690 | 11/1932 |

(Continued)

OTHER PUBLICATIONS

EP 0 378 011, Thomas, Jul. 1990, Machine translation.*

(Continued)

*Primary Examiner* — Mark Halpern

(74) *Attorney, Agent, or Firm* — Haynes and Boone, LLP

(57) ABSTRACT

A device and method for filling at least one container with fill product are described. The device includes a product reservoir for accommodating the fill product and a stirring element (for stirring the fill product accommodated in the product reservoir. The depth of immersion of the stirring element in the product reservoir can be varied.

19 Claims, 2 Drawing Sheets

(56) References Cited

U.S. PATENT DOCUMENTS

| | | | | |
|---|---|---|---|---|
| 5,350,232 | A * | 9/1994 | Kreuziger | B01F 9/02 366/139 |
| 5,538,462 | A * | 7/1996 | Gnadt | B23F 23/00 451/114 |
| 6,491,423 | B1 * | 12/2002 | Skibo | B01F 3/1221 266/235 |
| 2003/0158077 | A1 * | 8/2003 | Yamamoto | C04B 24/2647 510/475 |
| 2010/0221568 | A1 * | 9/2010 | Kruse | B01F 15/065 428/560 |

FOREIGN PATENT DOCUMENTS

| | | |
|---|---|---|
| DE | 12 16 845 | 5/1966 |
| DE | 19 54 947 | 2/1967 |
| DE | 20 2005 004 188 | 5/2005 |
| DE | 10 2010 031873 | 1/2012 |
| DE | 10 2012 104 275 | 11/2013 |
| EP | 0378011 | 7/1990 |
| EP | 2055372 | 5/2009 |
| EP | 2689830 | 1/2014 |
| GB | 472673 | 9/1937 |

OTHER PUBLICATIONS

European Patent Application No. 15187025.0, Extended European Search Report, 7 pages, dated Jan. 22, 2016.

European Office Action, European Patent Application No. 15 187 025.0, dated Dec. 15, 2016, 4 pages.

Search Report, German Patent Application No. 102014113986.0, dated Jun. 1, 2015, 8 pages.

* cited by examiner

DEVICE AND METHOD FOR FILLING CONTAINERS WITH A FILL PRODUCT

CROSS REFERENCE TO RELATED APPLICATIONS

This application claims priority from German Patent Application No. DE 10 2014 113 986.0, filed on Sep. 26, 2014 in the German Patent and Trademark Office, the disclosure of which is incorporated herein by reference in its entirety.

BACKGROUND

Technical Field

The present invention relates to a device for filling at least one container with a fill product, and a method for filling a container with a fill product using such a device.

Related Art

In filling devices for filling a fill product into containers, in particular in the field of filling and dosing machines for fluid or viscous foodstuffs such as for example beverages, it is known to make the fill product available in a product reservoir, from which the actual filling elements for filling the containers with the fill product are supplied. Product reservoirs are known for example in the form of a tank, a ring bowl or a central bowl of a rotary filling machine, and are usually provided at a level above the filling elements. In normal operation of a rotary filler, the product reservoir rotates together with the filling elements that are disposed upon it, in order thereby to enable continuous filling of containers that are successively supplied for filling.

The filling elements that are provided can be either piston filling elements, which enable the handling of fill product at underpressure and overpressure, or filling elements from which the fill product flows under its own weight. Piston fillers are usually used for high viscosity fill products such as cream, ketchup or baby food.

With fill products containing particles, it can occur that the different phases of the fill product separate in the filling and dosing machine, for instance if the particles have a tendency to sink lower or float upwards. Examples of such fill products containing particles are milk products with fruit components, or juices with fruit pulp. In order to avoid such separation or division of product components, a motor-driven stirring device is used, which is integrated in the product reservoir and permanently immersed in the product reservoir. This can be achieved, for instance in the case of foodstuff filling using a piston doser in a rotary-type process, either by means of motorized stirring devices or by means of fixed mixers, which protrude permanently into the fill product from a non-rotating part of the machine into the rotating product reservoir that is filled with product. Such a mixer thus serves during the rotational movement of the product reservoir to mix the fill product, and inhibits the rapid separation of components of the product that is to be filled, thus providing consistent product quality.

DE 10 2012 104 275 A1 describes a device for filling containers, which has such a mixer. The mixer is implemented as a fixed agitator blade, permanently immersed in the fill product. Such a fixed agitator blade, permanently immersed in the fill product, is also disclosed in DE 10 2010 031 873 A1.

The disadvantage of such devices is that the permanent stirring of the fill product increases the risk of bubble formation, foam formation and/or mechanical stressing of the fill product, which in the case of certain fill products can lead to reduction of the accuracy of filling and/or to deterioration in the quality of the filled fill product.

As well as the above-mentioned problems, which result from the permanent mechanical mixing of the fill product, a further problem exists in conventional filling and dosing machines, in that if operation is interrupted for any reason the fill product undergoes a change in temperature, such that its temperature may no longer lie within the temperature range required for filling.

This is because in many applications the temperature of the product that is to be filled is controlled for microbiological reasons (for instance in the case of the hot filling of juices) or for reasons of processability in the case of foodstuffs that are viscous or whose texture changes with temperature (for example when filling fruit jellies or jams).

In DE 10 2012 104 275 A1, the temperature is controlled by means of a heat exchanger provided in the product reservoir. Specifically, the temperature control of the product is carried out, for example, by means of a double-walled product reservoir through which cooling or heating medium flows, or alternatively by means of heating coils attached to the fixed part of the device, which are permanently immersed in the fill product in the product reservoir.

When the temperature of the dosed product is controlled in the rotating product reservoir by means of heating or cooling jackets, the design requires an elaborate and costly means of supplying and discharging cooling or heating medium (for example warm or cold water, or steam). This involves additional expense in terms of process control and equipment. Fixed temperature control elements that are permanently immersed in the rotating product reservoir (for example a heating coil) are also suboptimal from the cleaning point of view.

To summarize, in the state of the art two problem areas may be identified in devices for filling containers that have a rotatable product reservoir: a) problems resulting from the permanent mixing of the fill product, and b) problems in connection with the temperature control of the fill product.

SUMMARY

A device for filling at least one container with fluid fill product and a method for filling containers using such a device, which improve accuracy of filling and avoid a reduction in quality of the fill product due to the filling process, are described.

Accordingly, a device for filling at least one container with a fill product, including a product reservoir for accommodating the fill product and a stirring element for stirring the fill product accommodated in the product reservoir is proposed. According to the invention, the depth of immersion of the stirring element in the product reservoir can be varied.

By means of the variability of the depth of immersion of the stirring element in the product reservoir, the mechanical stress on the fill product can be varied, and in particular reduced in regular filling operation, which makes it possible to avoid or at least reduce on the one hand the entry of air into the fill product, and on the other hand a deterioration of the quality of the fill product due to the mechanical stress exerted by the stirring element. Additionally, the energy consumption resulting from the stirring of the fill product can be optimized.

The term "fill product" as used herein is to be understood here as low viscosity, high viscosity and paste-like fluids, as well as well as multi-phase fluids and those with particles. The term includes beverages of all types, along with yogurt, jam, jelly and other foodstuffs that can be filled or dosed by means of a filling and dosing machine, in particular a piston doser. The product reservoir holds the supply of fill product from which the filling elements, for example the piston fillers, are then fed in order to fill the fill product directly into the containers.

The product reservoir is usually not completely filled with fill product, which is instead present up to a certain fill level, or in other words a certain fill height. In the case of water, the fill level in a stationary product reservoir corresponds approximately to the surface of the water. A stirring element is provided in the product reservoir. It is also of course possible to provide a plurality of stirring elements. When in the following description "the" or "a" stirring element is mentioned, but no mention is made of a plurality of stirring elements, this is only in the interest of clear presentation. This applies similarly to other features of the device, even if it is not explicitly stated that the applicable feature can be multiply realized.

The stirring element is in several embodiments displaceable at least between a stirring position, in which the stirring element is immersed in the fill product, and an idle position, in which the stirring element is fully or partly outside the fill product. Accordingly the mixing function that is provided by the stirring element is activated only when it is required, for example during an interruption of normal filling operation. The activation generally takes place automatically.

By this means, the care with which the fill product is handled is further increased, and the energy consumption is further optimized. During normal, operation of the device, e.g., during normal filling operation, the dwell time of the fill product in the product reservoir is relatively short, and since fill product is constantly added to the product reservoir mixing may not be necessary. In this case, the stirring element can be withdrawn fully from the fill product. Due to design considerations, it may be that parts of the stirring element that do not influence the fill product, or influence it only slightly, remain in the fill product. For this reason, it is also possible that the above-mentioned effects are achieved by an only partial withdrawal of the stirring element from the fill product. In some embodiments, however, the stirring element is fully outside the fill product when in its idle position. In connection with this, attention is drawn to the following: when it is stated that the depth of immersion of the stirring element in the product reservoir can be varied, this also includes cases in which the stirring element is in certain positions, for example the idle position, outside the product reservoir. It is important to the functioning of the stirring element that the stirring element is adjustable relative to the level of the fill product, and can be immersed into the fill product.

The stirring element is in some embodiments mounted on a non-rotating part of the device, and is stationary relative to said part in the direction of rotation of the product reservoir. In other words, the device generally has one or a plurality of device components that do not rotate with respect to the product reservoir, and are thus in this sense fixed. According to this embodiment, the stirring element is stationary relative to the product reservoir, with the exception of the variability of its depth of immersion, or its position relative to the fill product level. By this means, a particularly simple design of the device is achieved, since elaborate mechanisms to drive and control the stirring element can be dispensed with.

In certain embodiments, the variation of the depth of immersion of the stirring element is achieved by means of a drive, for example, by means of a pneumatic and/or electrical drive. A simple, but nevertheless efficient means of adjustment is thereby achieved. In this case, the stirring element can have for example a vane which effects the mixing of the fill product, and a vane mount which is directly connected with an adjustment mechanism. The adjustment mechanism can have a pneumatic cylinder and/or electric motor and/or electromagnets, etcetera.

In some embodiments, the temperature of at least sections of the stirring element can be controlled. By means of the control of temperature, in combination with the variability of the depth of immersion of the stirring element, appropriate temperature control and appropriate mixing of the fill product can be simultaneously achieved. This is particularly important in the event of an interruption to normal filling operation, during which both the mixing and the temperature of the fill product must be maintained, in order that when the filling operation is resumed the fill product in the product reservoir can immediately be used for filling, and in particular does not need to be discarded.

The simple fact that the depth of immersion of the stirring element can be varied can also contribute directly to the appropriate temperature control, since the starting point and finishing point of the temperature control can be specified precisely by means of the immersion of the stirring element in the fill product and its withdrawal therefrom, without the occurrence of undesired heat exchange due to the thermal inertia of the heat exchanger or the materials of the stirring element.

Due to the fact that the stirring element is typically mounted on the non-rotating part of the machine, there is no need, for example, for elaborate designs of rotary distributors for the circulation of cooling or heating medium or the circulation of the product itself, or for slip rings for transmitting electric current on the rotating part of the machine, etc. The additional expense for equipment as well as for the control and regulation of the device is reduced to a minimum, which enables saving of acquisition and maintenance costs.

Especially in the case of the dosing of foodstuffs, savings of fill product can be made by means of the temperature control via the stirring element while the machine is stationary, since the temperature control of the fill product during the standstill period can maintain it within a specific temperature range and in a specified mixed state, so that the fill product does not need to be discarded. The temperature control via the stirring element is another means of saving energy and handling the fill product with care, in that the temperature control is only carried out when it is necessary.

The stirring element can, in various embodiments, be heated electrically and/or can have a flow-through of a heating or cooling medium. If the stirring element has, as suggested above, a vane and a vane mount, the vane can be implemented as an electrically heatable vane, and the power supply can be via a cable in the interior of the vane mount. Of course it is also possible to provide a plurality of vanes. These can be coated with a product-compatible and/or heat-resistant material, for example Teflon® brand coatings or ceramic. A sheathing of stainless steel or other materials can also be envisaged. Alternatively, the stirring element, for instance the one or more vanes, can be provided with one or more tubes, pass partition plates or hoses running through the interior, which convey a gaseous or fluid medium. This can be steam, hot water, cold water or another heating or cooling medium. Temperature control can of course also take place by means of evaporating media.

The angle of attack of the vane or vanes is generally adjustable, in order to achieve optimum mixing results for the current fill product, or according to its viscosity. The stirring elements can also if necessary be provided with variable dimensions, e.g., they can be expanded.

A level sensor for measuring the fill product level or the fill height of the fill product in the product reservoir is provided in various embodiments, which serves to simplify the efficient control of the stirring element, as regards both its adjustability and, if applicable, its temperature control. Generally, for this purpose a controller is connected not only to the stirring element or its adjustment mechanism, but also to the level sensor for measuring the level of the fill product.

In addition, or as an alternative, a temperature sensor for measuring the temperature of the fill product is provided. This too can be connected to the above-mentioned controller.

The above-mentioned stirring mechanism is particularly suitable for piston fillers, which implement the dosing of the fill product by means of pistons. This suitability results from the fact that piston fillers are typically used with high viscosity fluids such as yogurt, jam etc., which in many product variants contain additional solids such as for example fruit pulp, chocolate chips or caramel chips. In this case, during normal filling operation, unnecessary stirring, and possibly unnecessary temperature control, are detrimental to the quality of the fill product. In particular, the particles are no longer ground smaller by the constant mechanical action. Optimization of the stirring and temperature control processes in normal filling operation and during an interruption of normal filling operation is therefore particularly advantageous when piston fillers are used.

Accordingly, a method for filling at least one container with fill product by means of a device comprising a product reservoir for accommodating the fill product and a stirring element for stirring the fill product accommodated in the product reservoir is proposed, the device being, in some embodiments, one of the devices described above. According to the invention, the depth of immersion of the stirring element in the product reservoir is varied depending on an operating state of the device.

Possible operating states of the device include, among others, normal filling operation and an interruption of normal filling operation, for instance in the event of a malfunction of the plant or its maintenance. Other circumstances, however, can also determine the stirring and temperature control modes of the stirring element.

According to some embodiments, in the event of an interruption of normal filling operation of the device, the stirring element is lowered into the fill product in the product reservoir. As the product reservoir continues to rotate and/or the stirring element is actively driven to rotate, separation of the components of the product is reduced or prevented from arising. It is also possible for heat or cold to be transferred from the stirring element to the fill product.

The stirring element is in various embodiments disposed at least partially outside the fill product in normal filling operation, and immersed in the fill product during an interruption of filling operation.

Because, depending on the fill height of the fill product in the product reservoir, the stirring element may not be covered, the level sensor described above, which typically communicates with the controller of the device, checks in a particular embodiment whether the product reservoir contains sufficient fill product to cover the stirring element. If necessary, fill product is added via a product feed valve until the product reservoir contains sufficient fill product. By means of the above-mentioned temperature sensor, the temperature can be adjusted to a predetermined desired temperature. During the periods in which the device is stopped, the product reservoir continues to rotate, possibly at a reduced rate of rotation, or the stirring element rotates, in order to cause the fill product to flow past the stirring element and thereby warm or cool the fill product where necessary. When the device restarts in order to resume normal filling operation, the stirring element is placed in its idle position, in which the stirring element has been fully or partially displaced out of the fill product.

Although the present invention is in various embodiments employed in the filling of containers with foodstuffs, it is evident that the invention can also be applied in other fields, for example in the filling or dosing of paints, varnishes or other low and high viscosity fluids. In addition, further advantages and features of the present invention are evident from the description of embodiments that follows. The features described therein can be employed individually or in combination with one or more of the features mentioned above, if and to the extent that the features are not inconsistent with each other.

BRIEF DESCRIPTION OF THE FIGURES

Further embodiments and aspects of the present invention are more fully explained by the description below of the figures.

DETAILED DESCRIPTION

Examples of embodiments are described below with the aid of the figures. In the figures, elements which are identical or similar, or have identical effects, are designated with identical reference signs, and repeated description of these elements is in part dispensed with in the description below, in order to avoid redundancy.

Figure 1A:
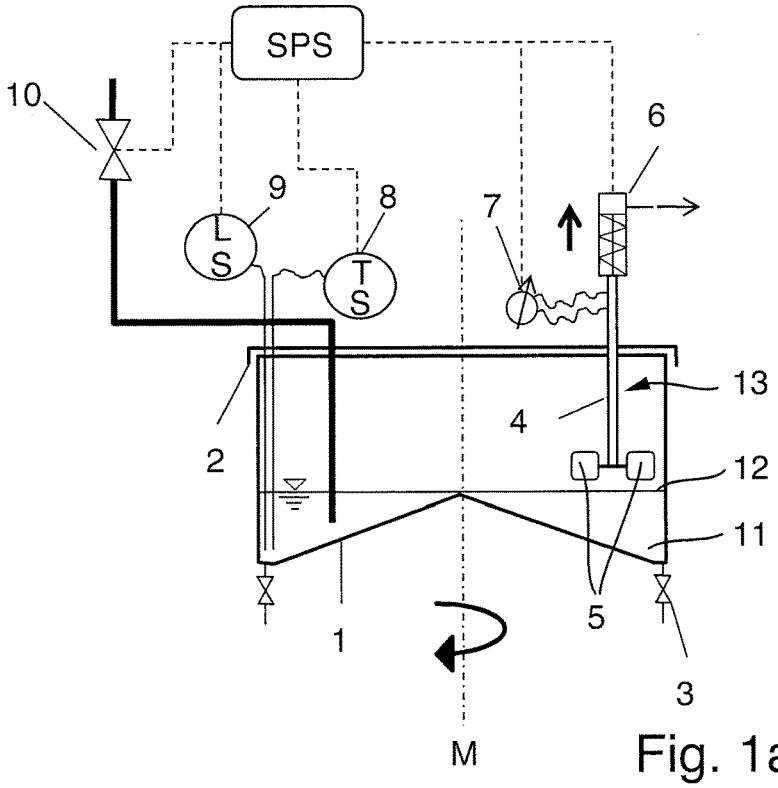
FIGS. 1*a* and 1*b* are a schematic representation of a rotatable product reservoir for a device for filling containers, in each case with a stirring element, which is disposed outside the fill product in FIG. 1*a* and immersed in the fill product in FIG. 1*b*.
Figure 1B:
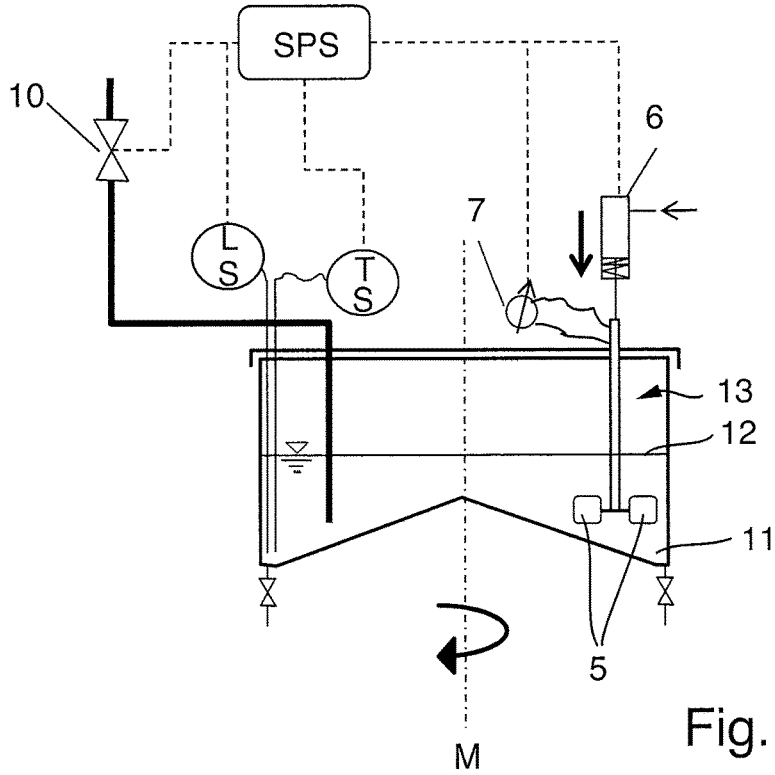

FIGS. 1*a* and 1*b* show schematically a product reservoir 1 of a rotational filling machine, for example a piston filler, which is partially filled with a fill product 11. The fill height of the fill product 11 in the product reservoir 1 is termed the fill product level 12. The product reservoir 1 is rotatable about an axis of rotation M, as indicated by an arrow around the axis of rotation M. In the example embodiment shown, the product reservoir 1 is closed by a lid 2, which is stationary, and thus does not rotate with the product reservoir 1.

A stirring element 13 is immersed in the product reservoir 1, serving to stir the fill product 11 accommodated in the product reservoir 1. The stirring element 13 can be varied in respect of the depth to which it is immersed in the product reservoir 1, so that the depth of immersion of the stirring element 13 can correspondingly also be varied with respect to the fill product level 12 of the fill product 11 in the product reservoir 1.

By this means, it is possible to obtain differing depths of immersion of the stirring element 13 in the fill product 11; the stirring element 13 at a first depth of immersion in the product reservoir 1 is disposed fully or partially in contact with the fill product 11, and at a second depth of immersion in the product reservoir 1 is disposed fully outside the fill product 11. For this purpose, the depth of immersion is generally variable between an upper and a lower end position of the stirring element 13.

The depth of immersion derives from the displacement of the stirring element 13 into the product reservoir 1, and can be defined objectively in terms of the distance of the stirring element 13 from fixed parts of the product reservoir 1, for example from the base of the product reservoir 1. If the stirring element 13 is deeply immersed in the product reservoir 1, the distance of the stirring element 13 from the base of the product reservoir 1 is smaller than when the stirring element 13 is less deeply immersed. The depth of immersion can also be defined with respect to an upper edge of the product reservoir 1.

Accordingly, by variation of the depth of immersion of the stirring element 13 in the product reservoir 1, it is possible also to achieve a variation in the depth of immersion of the stirring element 13 in the fill product 11 that is currently accommodated in the product reservoir 1, and the depth of immersion can also be adjusted relative to the fill product level 12. To achieve this, the depth of immersion of the stirring element 13 is generally continuously or almost continuously variable between an upper and a lower end position.

Because the stirring element 13 in its upper end position is raised fully out of the fill product 11, filling of the fill product can be performed undisturbed by the stirring element 13, with the rotational filling machine operated at its intended filling speed and the product reservoir 1 correspondingly rotating at the intended speed. During this time, due to the continuous extraction of the fill product from the product reservoir 1, in combination with the rotation of the product reservoir 1, a flow of the fill product 11 in the product reservoir 1 is achieved, which counteracts the separation of the individual components of the fill product 11. Furthermore, the dwell time of the fill product 11 in the product reservoir 1 is relatively short, since usually the same volume of fill product 11 flows in via the inlet as flows out simultaneously via the filling elements into the containers that are to be filled. Hence it is possible to dispense with the immersion of the stirring element 13 in the fill product 11 during normal filling operation, since separation of the components or a change in other physical properties—for example a change in temperature—is not to be feared. Because the stirring element 13 is not immersed in the fill product 11, the filling process is not influenced, since the flow conditions in the product reservoir 1 are not disturbed by the stirring element 13.

In the present embodiment, the stirring element 13 has a vane mount 4 and two vanes 5. A drive in the form of a pneumatic cylinder 6 is further provided, connected to the vane mount 4, whose height, together with that of the vanes 5, can thereby be adjusted, so that the depth of immersion of the stirring element 13 in the product reservoir 1 can be correspondingly varied. To achieve this, either the vane mount 4 can be displaced only to the upper and lower end positions, or the vane mount 4 can be displaced to any desired position between the upper and lower end positions, in order that variable adjustment of the depth of immersion-which can also be independent of the current product fill level 12-can be achieved.

The vanes 5 can further be set in rotation around the axis formed by the vane mount 4, in order to stir the fill product 11.

FIG. 1*a* shows a state in which the vanes 5 are outside the fill product 11, e.g., the stirring element 13 is not immersed in the fill product 11 and accordingly also cannot interact with the fill product 11. In the state that is shown in FIG. 1*b*, the vanes 5 and a portion of the vane mount 4 are immersed in the fill product 11.

The vane mount 4 is displaceable in an upwards and downwards direction through the non-rotating lid 2, through which it passes if necessary. The pneumatic cylinder 6 and/or the vane mount 4 are attached to the rotary filling machine at a suitable point on the non-rotating part of the device, such that the stirring element 13 is displaceable at least between an upper and a lower end position.

The temperature of the vanes 5 can be controlled, e.g., they can be heated and/or cooled. In the example embodiment shown, the vanes 5 are electrically heatable. The power supply to the electrically heatable vanes 5 is via a cable that passes through the interior of the vane mount 4, and is implemented such that it is controllable by means of a temperature controller 7. Accordingly, heat can be transferred to the fill product 11.

In a further embodiment, the vanes 5 are implemented such that they can be cooled, in order to cool the fill product 11.

Depending on the requirements, and the characteristics of the fill product 11, it is possible to increase or decrease the number of vanes 5 whose temperature can be controlled and/or whose surface area can be enlarged, reduced, or adjusted in its geometry in another manner, in order to enable the optimization of a transfer of heat or cold to the fill product 11.

Examples of geometrical embodiments of the vanes 5 are shown in FIGS. 2*a* to 2*f*. The angle of attack of the vanes 5 can, where appropriate, be adjustable to adapt to particular applications, in order to achieve an optimum mixing outcome and/or an optimum heating or cooling output.

In the embodiment that is shown, a level sensor 9 is provided for measuring the fill product level 12 of the fill product 11 in the product reservoir 1. The level sensor 9 communicates with a controller, which can for example be designed as a programmable logic controller PLC. A temperature sensor 8 is also provided; this too can communicate with the controller PLC. It should be noted that the level sensor 9 and the temperature sensor 8 do not necessarily have to be provided in the product reservoir 1 itself. Stated in general terms, the level sensor 9 and the temperature sensor 8 can also be dispensed with in certain embodiments, or generally embodied as devices for determining the applicable parameters. The product level 12, for example, can also be determined from measurement of the inflow and outflow of fill product 11 into and out of the product reservoir 1.

In order to fill the product reservoir 1, a product feed valve 10 is provided. The pneumatic cylinder 6, the temperature controller 7, the temperature sensor 8, the level sensor 9 and the product feed valve 10 are connected to the programmable logic controller PLC. By means of the programmable logic controller PLC, the values from the sensors are captured and the applicable components are controlled.

In the lower area of the product reservoir 1, filling elements 3 are shown schematically. In FIGS. 1*a* and 1*b*, these are shown simply as valves.

In the following part of this description, a special possibility for operating the device shown in FIGS. 1*a* and 1*b* is disclosed. When the plant is at a standstill and the supply of containers to the filling machine is suspended, the vane mount 4 is lowered by means of the actuator device 6 into the fill product 11 in the product reservoir 1 (see FIG. 1*b*), by which means the electrically heatable vanes 5 are immersed in the fill product 11 in order to reduce separation of the product components while minimizing bubble formation, and in order to maximize the transfer of heat from the vanes 5 to the fill product.

Depending on the fill product level 12 of the fill product 11 in the product reservoir 1, it is possible that the vanes 5 are not covered. Because of this possibility, the level sensor 9 in the product reservoir 1, which communicates with the controller PLC, is used to check whether there is sufficient fill product 11 to cover the vanes 5, and if necessary fill product 11 is added via the product feed valve 10 until the product reservoir 1 contains sufficient fill product 11. Alternatively, or in addition, the actuator device 6 can again be operated, in order to immerse the vanes 5 further in the fill product 11.

By means of the temperature controller 7, if necessary in communication with the controller PLC and the associated temperature sensor 8, the vanes 5, which are in this case electrically heatable, are adjusted to a predetermined desired temperature. While the filling device is stopped, the product reservoir 1 rotates at a reduced speed, in order to cause the fill product 11 to flow past the heatable vanes 5 and thereby supply thermal energy, as well as mix the fill product to provide a homogenous temperature distribution and reduce separation. When the filling device is stopped, the product reservoir 1 can also come to a complete stop, and accordingly no longer rotate about the axis of rotation M. The agitation of the fill product 11 is then effected by means of the rotation of the vanes 5 of the stirring element 13 in the fill product 11, in order to prevent the separation of different components.

When the plant restarts, the stirring element 13 can be returned to its upper end position and withdrawn from the fill product 11 in the product reservoir 1.

Figure 2A:
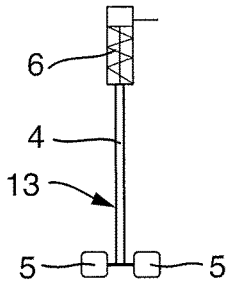
FIGS. 2*a* to 2*f* show different implementations of the stirring element.
Figure 2B:
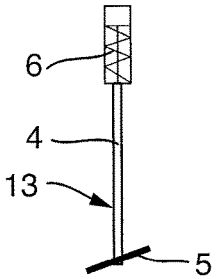
Figure 2C:
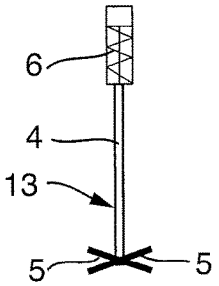
Figure 2D:
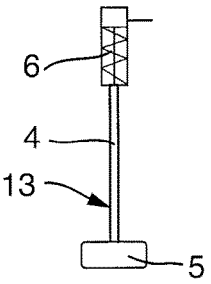
Figure 2E:
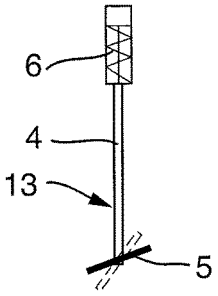
Figure 2F:
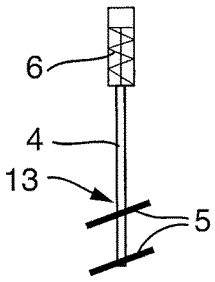

FIGS. 2*a* to 2*f* show example embodiments of the stirring element 13. In FIG. 2*a*, two electrically heatable vanes 5 are provided, which are attached to the vane mount 4. In FIG. 2*b*, the stirring element 13 has a stirring rod 5, whose inclination may be adjustable. The adjustability of the position of the stirring rod 5 is indicated in FIG. 2*e* in that a highly tilted orientation is indicated by broken lines. In FIG. 2*c*, two intersecting stirring rods are shown. FIG. 2*f* shows two stirring rods 5, oriented parallel to each other and spaced apart. An example embodiment with only a single vane 5 is shown in FIG. 2*d*.

The vanes or stirring rods 5 can be suitably coated, for example with a product-compatible and/or heat-resistant material, for example Teflon® brand coatings or ceramic. Electrically heated platens sheathed in stainless steel can also be envisaged, as are vanes whose interior contains tubes, pass partition plates and/or hoses to convey a heating or cooling medium.

To the extent applicable, all individual features described in the example embodiments can be combined with each other and/or exchanged, without departing from the field of the invention.

The invention claimed is:

1. A device for filling at least one container with a fill product, comprising:

a product reservoir that accommodates the fill product;

a stirring element that stirs the fill product accommodated in the product reservoir, wherein the stirring element is displaceable at least between a stirring position, in which the stirring element is immersed in the fill product, and an idle position, in which the stirring element is fully or partly outside the fill product;

means for varying a depth of immersion of the stirring element in the product reservoir; and a controller operatively associated with the stirring element and configured to dispose the stirring element at least partially outside the fill product during a filling operation and immerse the stirring element in the fill product during an interruption of the filling operation.

2. The device of claim 1, wherein the stirring element is mounted on a non-rotating part of the device, and is stationary relative to the non-rotating part in a direction of rotation of the product reservoir.

3. The device of claim 1, further comprising means for controlling a temperature of at least a section of the stirring element.

4. The device of claim 3, further comprising means for causing the at least a section of the stirring element to be heated and/or cooled.

5. The device of claim 1, wherein the stirring element comprises at least one vane.

6. The device of claim 5, wherein an angle of the at least one vane with respect to a vertical axis of rotation of a vane mount is adjustable.

7. The device of claim 1, further comprising a level sensor that measures a fill product level in the product reservoir.

8. The device of claim 1, further comprising a temperature sensor that measures a temperature of the fill product in the product reservoir.

9. The device of claim 1, further comprising at least one filling element in the form of a piston filler that fills at least one container connected to the product reservoir, wherein the filling element rotates with the product reservoir about an axis of rotation of the product reservoir.

10. The device of claim 1, further comprising a temperature controller configured to control a temperature of an interior of the stirring element.

11. The device of claim 1, further comprising a product feed valve configured to add the fill product to the product reservoir.

12. The device of claim 1, wherein the stirring element comprises a vane mount and two vanes.

13. A method for filling the at least one container with the fill product by using the device of claim 1, comprising:

varying the depth of immersion of the stirring element in the product reservoir depending on an operating state of the device.

14. The method of claim 13, wherein the depth of immersion is varied automatically between the stirring position and the idle position.

15. A method for filling the at least one container with the fill product by using the device of claim 1, comprising:

lowering the stirring element to a lower end position from an upper end position into the fill product in the product reservoir during the interruption of the filling operation;

determining whether the fill product covers the stirring element;

adjusting the stirring element to a predetermined desired temperature;

agitating the fill product;

withdrawing the stirring element from the fill product once the filling operation resumes; and returning the stirring element to the upper end position.

16. The method of claim 15, further comprising adding the fill product until the fill product covers the stirring element.

17. The method of claim 15, wherein the stirring element is electrically heatable or coolable.

18. The method of claim 15, wherein a pneumatic and/or an electrical drive lowers the stirring element, withdraws the stirring element, and returns the stirring element.

19. The method of claim 15, wherein the upper end position comprises a position that is at least partially outside the fill product.

* * * * *